United States Patent [19]

Walsh

[11] Patent Number: 4,758,195

[45] Date of Patent: Jul. 19, 1988

[54] ELASTOMERIC FOAM BUILDING UNITS

[75] Inventor: Christopher T. Walsh, Auburn, N.Y.

[73] Assignee: 3 W Designers, Inc., Auburn, N.Y.

[21] Appl. No.: 904,299

[22] Filed: Sep. 8, 1986

[51] Int. Cl.[4] ..... A63H 33/12

[52] U.S. Cl. ..... 446/85; 446/122; 446/385; 401/196

[58] Field of Search ..... 446/85, 385, 95, 122; 401/196

[56] References Cited

U.S. PATENT DOCUMENTS

| | | | |
|---|---|---|---|
| 46,525 | 2/1865 | Harold | 446/85 |
| 879,455 | 2/1908 | Frost . | |
| 1,150,363 | 8/1915 | Haskins . | |
| 1,216,840 | 2/1917 | Ramsey et al. | 446/122 |
| 1,620,574 | 3/1927 | Savage | 446/85 |
| 1,783,151 | 11/1930 | McArthur | 401/196 |
| 1,894,605 | 1/1933 | Wright | 446/122 |
| 1,974,838 | 9/1934 | Schmid . | |
| 2,013,114 | 9/1935 | Smith | 446/385 |
| 2,052,600 | 9/1936 | Boss . | |
| 2,493,435 | 1/1950 | Archambault | 446/122 |
| 2,861,388 | 11/1958 | Favaretto . | |
| 2,921,407 | 1/1960 | Wagner et al. | 446/385 |
| 2,987,318 | 6/1961 | Hammer | 446/85 |
| 3,205,611 | 9/1965 | Onanian . | |
| 3,518,786 | 7/1970 | Holtvoigt | 446/85 |
| 3,556,667 | 1/1971 | Kaufman | 401/196 |
| 3,590,414 | 7/1971 | Gores | 401/196 |
| 3,603,026 | 9/1971 | Kishigami . | |
| 3,660,927 | 5/1972 | DeChristopher . | |
| 3,854,237 | 12/1974 | Loth . | |
| 3,975,858 | 8/1976 | Much . | |
| 4,219,961 | 9/1980 | Stiles | 446/85 |
| 4,336,767 | 6/1982 | Wada | 401/196 |
| 4,458,441 | 7/1984 | Bril | 446/122 |

FOREIGN PATENT DOCUMENTS

| | | | |
|---|---|---|---|
| 583528 | 1/1925 | France | 446/385 |
| 899791 | 6/1945 | France . | |
| 2229203 | 12/1974 | France . | |
| 370652 | 4/1932 | United Kingdom | 446/85 |

OTHER PUBLICATIONS

Instant Products, Inc., Jul. 30, 1986, 8 pages.

Custom Mfg. "Soft Blocks" flyer; 4 pages; no date given.

*Primary Examiner*—Victor N. Sakran

*Attorney, Agent, or Firm*—Nixon & Vanderhye

[57] ABSTRACT

Elastomeric foam blocks are provided for constructing toys and models with a means of attachment of one block to another block in the form of flexible protuberances and cellular receptacles present on all surfaces, so that when one or more blocks are engaged, a clinging force is generated. Furthermore, either independently of, or in collaboration with the above, another means of connecting said blocks is provided by inserting simple pins into the matrix of said foam in any direction and without preformed perforations. The pins are held in place in the perforations created by the insertion of the pins into the foam by the elastomeric forces inherent in the polymeric structure of the foam, and the perforations snap shut upon the removal of the pins, thus allowing the building units to be reused again to construct more toys and models.

19 Claims, 10 Drawing Sheets

ELASTOMERIC FOAM BUILDING UNITS

BACKGROUND AND SUMMARY OF THE INVENTION

Building block and construction model kits are generally either of the type that consist simply of blocks that may be placed one upon the other without connecting means to fasten them together, or of construction units or blocks of various shapes and sizes which are deliberately fastened together by providing, for example, interlocking means which are integral with the construction units themselves, or by strips, pins, nuts & bolts, clamps, etc. which are inserted through preformed holes, grooves, etc. in the building unit itself. These kits frequently only provide the means for constructing a limited variety of models because of the predetermined positioning of holes, grooves, etc. A more serious objection to such toys is the fact that the kits consist of many small connector pieces which are easily lost, or even more seriously, may be swallowed by infants, or perhaps be stepped upon and broken into even smaller pieces, plus the added hazard that the foot or bare foot itself may be injured.

It is also known to form toys, forms or shapes of a non-elastomeric foam composition. However, these items, some of which exhibit a clinging characteristic, do not comply with current safety standards and, in fact, fail upon subjection to required testing procedures.

This invention consists of building units with novel connecting means, made from soft elastomeric foam materials, with no small pieces that might be inserted into a child's eye, ear, nose, or swallowed. The elastomeric foam blocks of this invention meet all safety standards and thus introduce a new order of safety into the field of play blocks and the construction of models and toys associated therewith. My building units also pass the 1977 Consumer Product Safety Commission's "No Choke Test"; whereas some other heretofore mentioned devices are not only very noisy, heavy, slip-and-slide, and fall easily with a "crash", but also contain small, hazardous sub-component parts that fail the above "No Choke Test". My building units have none of these disadvantages.

This new invention provides a safe building unit kit that allows a child to build models representing any real or imagined objects with full exercises of the child's creative abilities unhampered by the restrictions often inherent in the old type building units because of the predetermined connector systems.

The single element building units and blocks of this invention are cut from very large molded blocks or buns of polymeric foams. The polymeric substances used to manufacture the elastomeric foam may be of various types such as esters, ethers, polyols, silicones, and other polymers such as vinyls, etc. I have successfully constructed kits using an elastomeric polyester urethane foam with densities ranging from 0.5 to 10.0 pounds per cubic foot and with elastomeric cell size ranging from 20 to 80 cells per linear inch, and a range of 200 to 400% elongation. In addition, protuberances on the surfaces of this foam material have a very, very significant effect upon the Angle of Repose. I tested equal surfaces and volumes of wood, plastic, and blocks according to this invention with respective densities of 41, 25 and 2 pounds per cubic foot on plate glass and 404 grade stainless steel and found the respective Angles of Repose on both surfaces were 16, 16 and 45 degrees.

Thus, the unique production feature of this invention provides considerably more holding power when adjacent to a smooth surface and lends greater design benefits to the creator-builder.

I have found that a foam block with optimum flexibility and elastomeric properties for building units is provided by an urethane polyester type foam with a density of 1.5 to 3.0 pounds per cubic foot; cell size ranging from 40 to 60 cells per linear inch; 225% to 275% elongation and an Angle of Repose of 30 to 50 degrees. Blocks fabricated from a foam of this type also have excellent squeeze/grab properties which make them easy to pick-up and manipulate for both the young and old who need to develop better eye and hand coordination or motor skills.

When a relatively large elastomeric foam building unit of the general type described above is cut to yield smaller building units, all surfaces of each building unit consist of flexible cell-cups. When these smaller building units are placed in contact with one another, the protuberances penetrate into the cell-cups and the building units cling together. Hence, all these building units work in harmony as one unique basic building element without the need of any other auxillary building elements, and as such, no other attachment means are required. There are no limitations to the orientation of building units when constructing a model; all pieces can be utilized in any order or in any orientation as a child creates his or her own objects. The building units may also be formed in an almost infinite variety of shapes and sizes. The building units are preferably assembled into kits of various sizes, and I have found that the best two sizes are the 100 piece set and the 25 piece set, with twelve distinct shapes, in four warm pastel colors.

These sets, in kit form, have reusable capabilities to convert ideas into prototype models, projects, and static toys which allow children's and adults' visions to become realities. For example, children, ages 3 and up, can build such simple items as a house, cross, tee-pee, umbrella, car, church, school, Mom, Dad, chair, shoe, sunrise/sunset, key, clock, animals, truck, cup, tree, etc.

The exterior of the building units with their protuberances and cell-cups is such that they absorb noise and do not generate any noise themselves. We have further found that teachers like the blocks' quietness because an activity with the blocks of this invention and another, unrelated activity can be conducted at the same time and in the same room, without confusion. Also, during the school play periods, if the children should throw the blocks at each other, no one will be injured. Sometimes, when the children appear to have extra energy, the teachers may deliberately allow the children to throw these soft blocks at each other in a fun way without anyone getting hurt, and somehow most of the soft blocks are directed at the teacher which also helps her to learn too! If the soft blocks are stepped upon accidentally, the blocks will not break or injure the foot because they compress and immediately assume their original shape when the compression force is removed.

I have observed that the single element building units with their clinging properties, are particularly attractive for children ages 3, 4, and 5. For older children, adults, and senior citizens, ages 6 and up, another means of connecting building units may be employed. In this advanced block type construction, representing a second exemplary embodiment of the invention, the elastomeric foam blocks with their thousands of interconnecting cells, function as uniform and near invisible perforations to accept simple pins or tubular connector elements in an almost infinite way, and yet when these perforations are not in use they elastomerically snap close. The substance of the elastomeric cell can be utilized to serve as the holding mechanisms for simple connecting pins which are capable of being inserted into the foam cells anywhere on the surface of the block. These simple pins can be solid or tubular, although I have found that the tubular connectors are better than the solid pins because they are lighter in weight, yet stiff enough to be inserted into the foam without bending, and readily secure the units or blocks together.

After it is determined by the creator-builder where the tubular connectors are to be inserted, I have further found that it is easy for a supervising teacher, parent, or grandparent to make a guide hole with a toothpick for example. The toothpick hole will make a pilot hole by breaking through the cellular membranes in a straight line and thereby make it much easier for the larger diameter tubular connectors to be inserted into and through the block and penetrate a second block in contact with the first block deeply enough to join them together. When the pins are withdrawn, the perforations elastomerically snap close.

The preferred length of these tubular connectors ranges from 3.0 inches (to pass the "No Choke Test") up to 15.0". The tubular connectors which I have experimented with range from very thin walled and flexible plastic straw type tubes to more rigid balloon-type polyolefin sticks with an outside diameter of 5/16th of an inch and a wall thickness of 1/16th of an inch. The preferred tubular connectors have a 3/16th inch outside diameter and wall thickness of 1/32th inch and are made of polyolefins, blends of styrene olefins or similar plastics.

From an esthetic point of view, clear tubular connectors are preferred for the children in the space-age mood, whereas multi-color tubular connectors can also be used for a more artistic look. The choice of color is left up to the mind of the creator-builders. This novel method of connecting building units provides a system with unlimited flexibility in the design and construction of objects. No restrictions have been imposed by the system of manufacture. The child is free to follow her or his creative instincts in building any structure that she or he is capable of imagining. Compared to previous systems, my systems encourages a child to create without limitations. The building units may be colored in various ways and the variety of shapes and sizes are without limit, too. In this regard, the invention is not necessarily confined to the specific descriptions in the foregoing disclosure nor is it limited in any way to the specific constructions illustrated and described further herein.

DETAILED DESCRIPTION OF THE INVENTION

Figure 1:
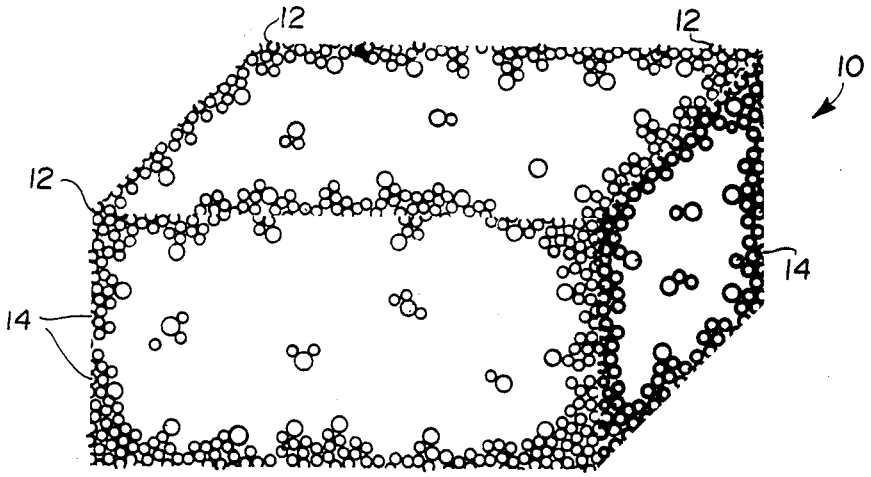
FIG. 1 illustrates the basic building unit with integral protuberances and cell cups.
Figure 2:
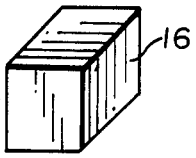
FIGS. 2 through 13 illustrate the various exemplary shapes and relative sizes of the building units in accordance with the invention.

Referring to FIG. 1, there is illustrated a foam block 10, preferably formed of a urethane polyester type foam with a density of 1.5 to 3.0 pounds per cubic foot. The block 10, when cut from a larger sheet or block of foam, includes along its exterior surfaces a plurality of protuberances 12 and cells, or cell cups 14 so that when one block is placed in contact with another, the protuberances of one block penetrate into the cells of an adjacent block, and vice versa, to hold the two blocks in assembled relationship without the necessity of any auxillary fastener elements. For optimum results, a cell size ranging from 40–60 cells per linear inch, with 225% to 275% elongation, plus an Angle of Repose of 30° to 50° is preferred.

With reference now to FIGS. 2 through 13, a number of three-dimensional elastomeric foam blocks are shown in various geometric configurations which would typically be included in a building unit kit in accordance with this invention.

Figure 8:
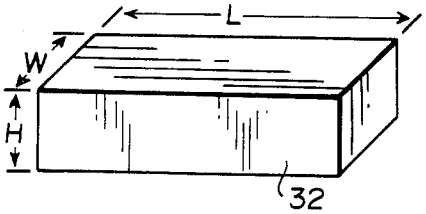

In FIGS. 2, 5, 8, and 13, regular polygonal blocks 16, 26, 32 and 42, respectively, are shown having various length, height and width dimensions, as indicated in FIG. 8. These dimensions may be altered as desired to provide square or rectangular blocks of differing dimensions.

Figure 3:
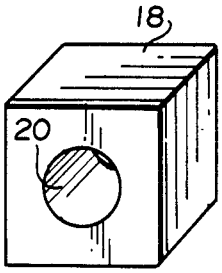
Figure 4:
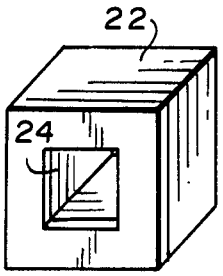
Figure 5:
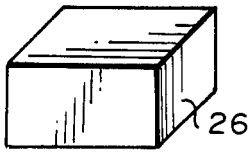

FIGS. 3 and 4 illustrate blocks 18, 22, respectively, which are substantially cube-shaped, and wherein block 18 has a cylindrical hole 20 formed therein, and block 22 has a substantially square hole 24 formed therein.

Figure 7:
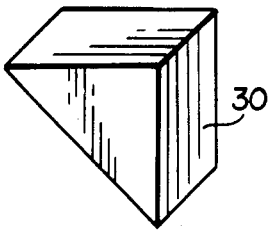
Figure 9:
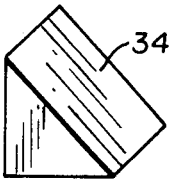
Figure 11:
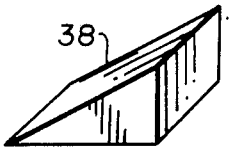

FIGS. 7, 9 and 11 illustrate various triangular shapes for blocks 30, 34, and 38, respectively.

Figure 6:
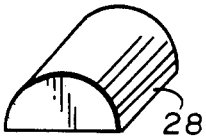
Figure 10:
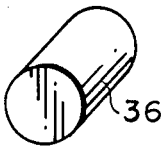
Figure 12:
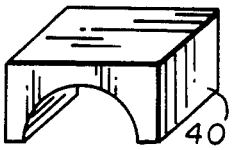
Figure 13:
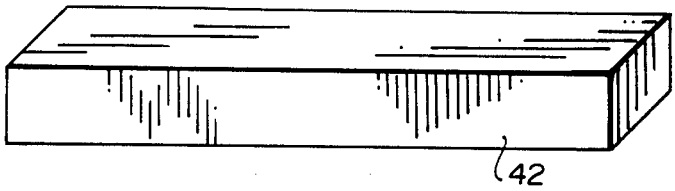

FIG. 6 illustrates a semi-cylindrical shaped block 28; FIG. 10 illustrates a cylindrical block 36; and FIG. 12 illustrates a substantially square block 40 wherein a semi-cylindrical portion such as that shown at 28 in FIG. 6 has been removed. It is to be understood that these specific shapes are merely exemplary of a virtually infinite variety of shapes in which the elastomeric foam blocks may be made.

In FIGS. 14 through 20 there are illustrated various assembled configurations utilizing elastomeric foam blocks of this invention which are either identical, or similar, to blocks disclosed in FIGS. 1 through 13. In FIGS. 14 through 20, blocks which are like to those shown in FIGS. 1 through 13 are indicated by identical reference numerals, while those which are similar but not identical to those in FIGS. 1 through 13 are indicated by like reference numerals with an added prime (') designation.

Figure 14:
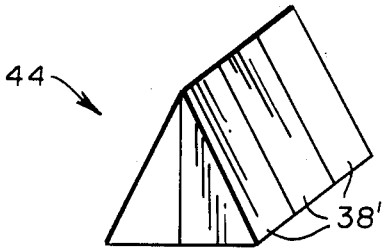
FIGS. 14 through 20 illustrate various stacking, bridging, and enclosure objects which can be constructed with the same or similar building elements as illustrated in FIGS. 2 through 13.
Figure 15:
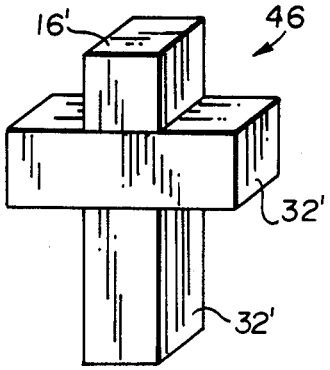

In FIG. 14, for example, the elastomeric foam blocks have been assembled in the shape of tent 44 utilizing a plurality of triangular blocks 38', similar to block 38 shown in FIG. 1. In FIG. 15, a cross-like object 46 is shown utilizing blocks 16' and 32'.

Figure 16:
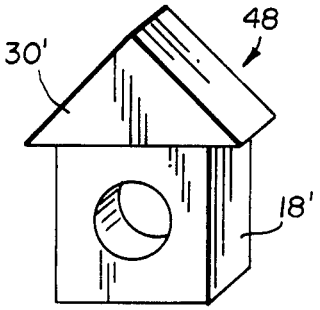

In FIG. 16, a house-like construction 48 is disclosed which is comprised of a bored block 18' and a triangular block 30'.

Figure 17:
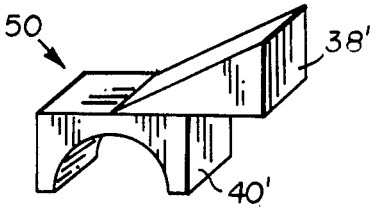

In FIG. 17, a shape resembling that of a small animal 50 is created by using a triangular block 38' and a cut-out block 40'.

Figure 18:
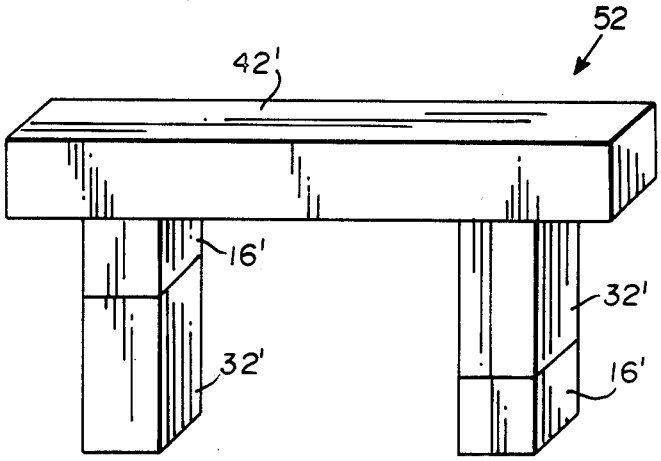

In FIG. 18, a structure 52 is disclosed which includes a plurality of vertically arranged blocks 16', 32' and a single, elongated, horizontal elongated block 42'.

Figure 19:
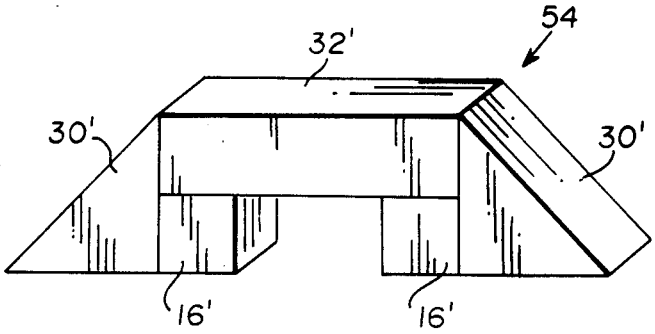

In FIG. 19, a gateway or bridge-like construction 54 is disclosed which comprises a pair of blocks 16', a pair of triangular blocks 30' and an elongated center block 32'.

Figure 20:
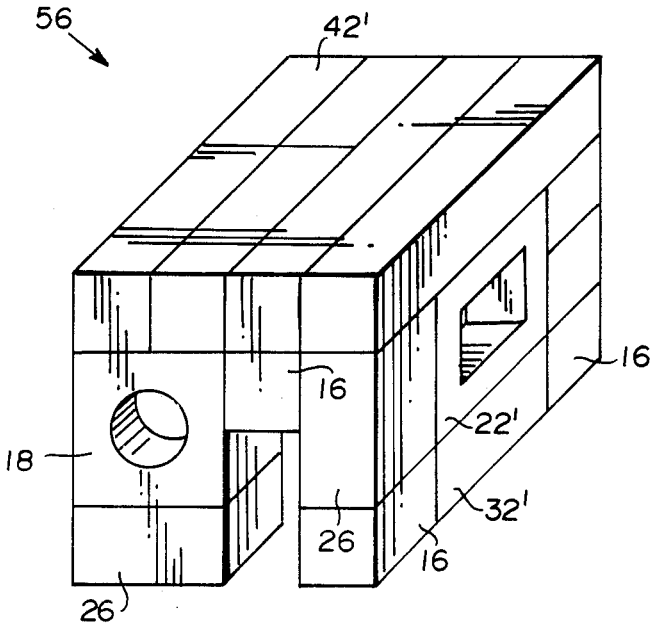

In FIG. 20, a building construction 56 is disclosed utilizing a plurality of blocks 16, 18, 22', 26 and 42'.

It will be understood that the configurations illustrated in FIGS. 14–20 are also merely exemplary of a virtually infinite number of shapes and objects which may be designed and assembled through the creative use of the elastomeric foam blocks of this invention.

Figure 21:
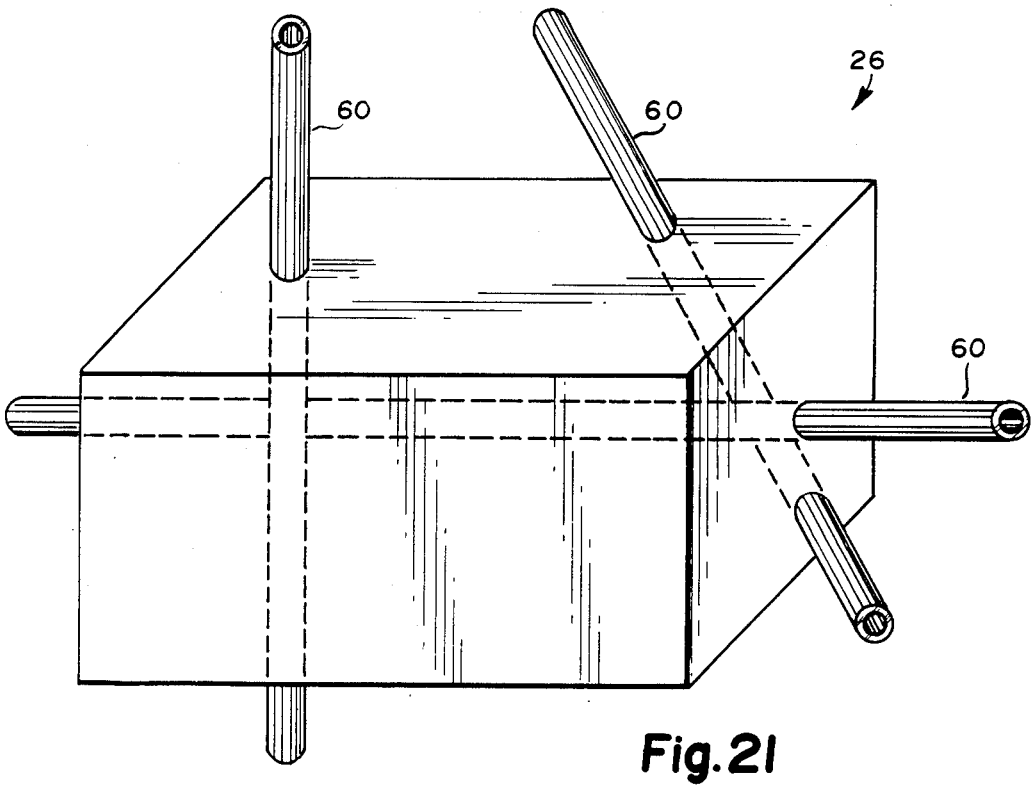
FIG. 21 illustrates a basic building unit with simple connector pins in accordance with an alternative embodiment of the invention.

In an alternative embodiment of the invention, designed primarily for older children, adults and senior citizens, the elastomeric foam blocks are interconnected by one or more pins or tubular connector elements which may be inserted into the foam blocks in virtually any position and, when the pins are removed, the foam blocks close up to assume their original shape. In this regard, FIG. 21 illustrates a foam elastomeric block 26 in which has been inserted three tubular connectors 60. It will be understood that the tubular connectors 60 may be solid as well as tubular, although the tubular configuration is preferred because of its lighter weight.

FIGS. 22 through 29 illustrate more complex constructions which may be created using the elastomeric foam blocks of this invention, and wherein it is also desirable to use tubular connectors 60.

Figure 22:
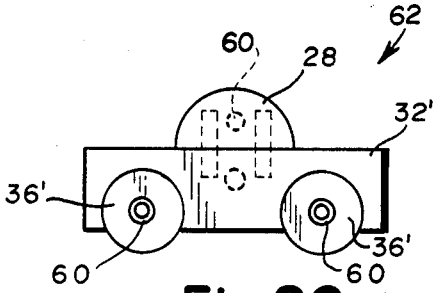
FIGS. 22 through 29 illustrate exemplary models and objects which can be built with combinations of simple connector pins and the elastomeric foam building block elements of this invention.
Figure 23:
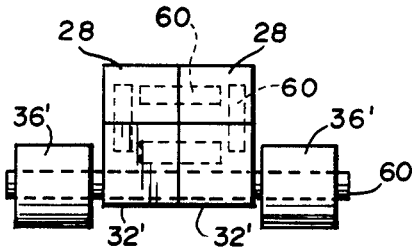
Figure 24:
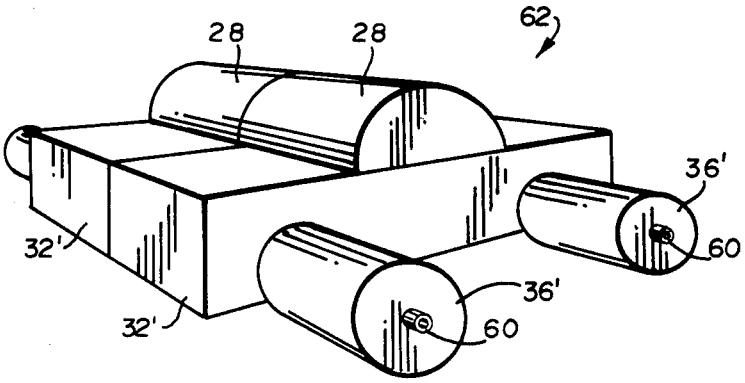

For example, FIGS. 22 through 24 disclose a vehicle-like configuration 62 which includes a pair of elongated body blocks 32', through which have been inserted a pair of tubular connectors 60 which simulate the axles of the vehicle. At opposite ends of the tubular connector 60, there are mounted cylindrical foam blocks 36' simulating the wheels. In addition, a pair of semi-cylindrical blocks 28 are applied atop the elements 32' to simulate the passenger compartment of the vehicle. As clearly shown in FIGS. 22 and 23, additional tubular connectors 60 are employed to fasten the various block components together.

Figure 25:
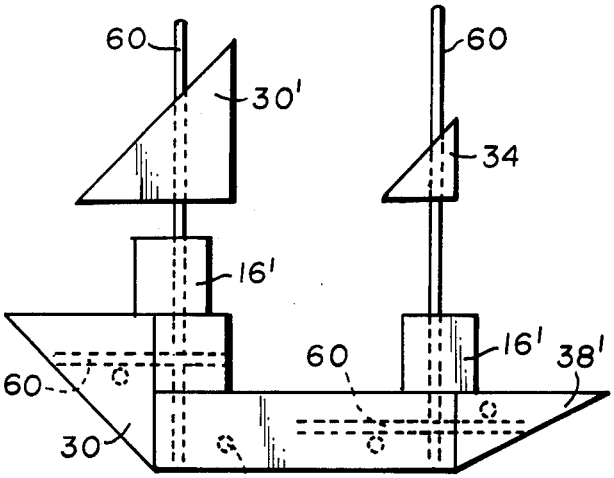
Figure 26:
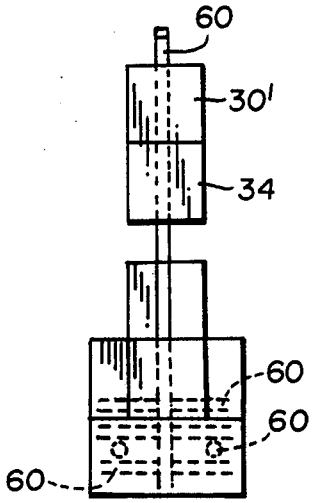
Figure 27:
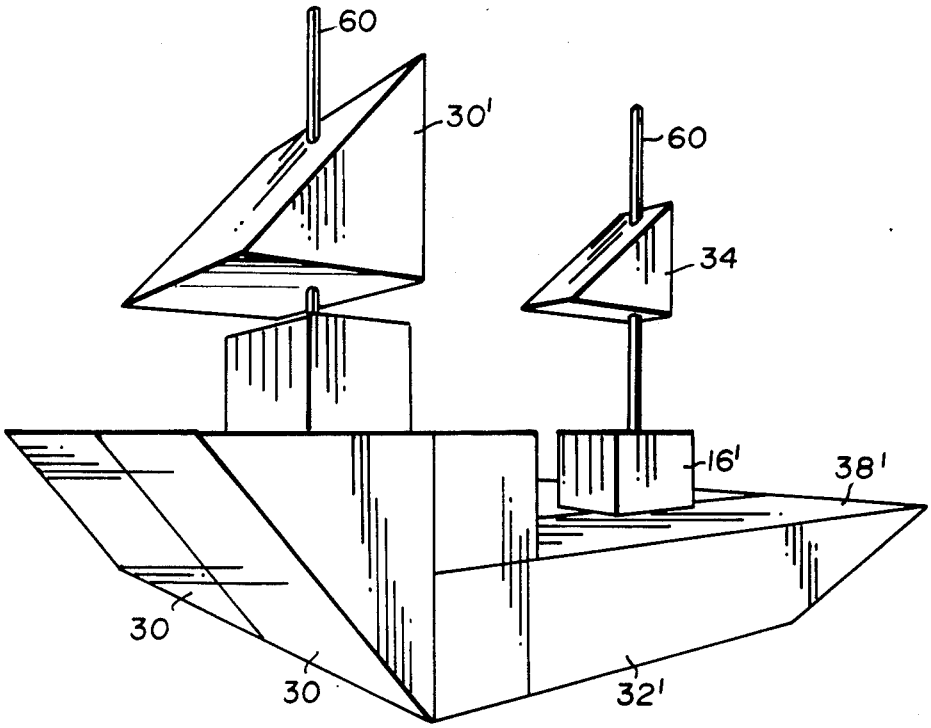

FIGS. 25 through 27 illustrate a ship-like configuration which also makes extensive use of the tubular connectors 60. Thus, a pair of connectors 60 are used to simulate the masts of a ship and are inserted through blocks 30', 34, respectively, which simulate the sails of the ship. The "hull" of the ship is constructed of a plurality of triangular blocks 30, elongated blocks 32' and one or more triangular blocks 38'. Additional blocks 16' are shown to simulate the cabin and/or other structure of the ship.

Figure 28:
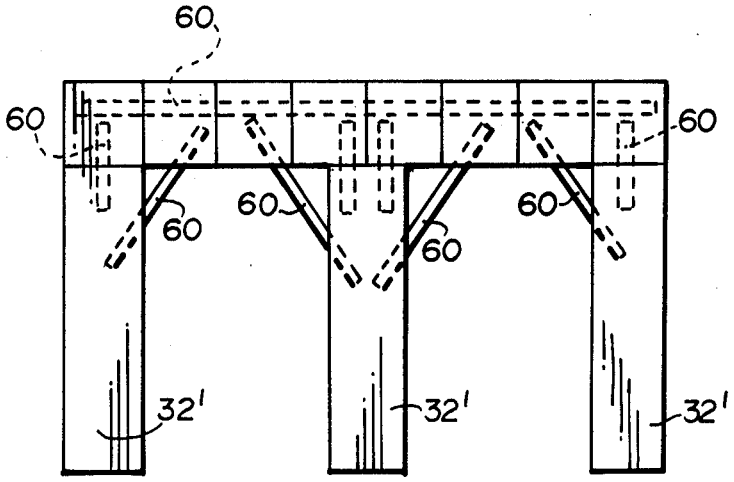
Figure 29:
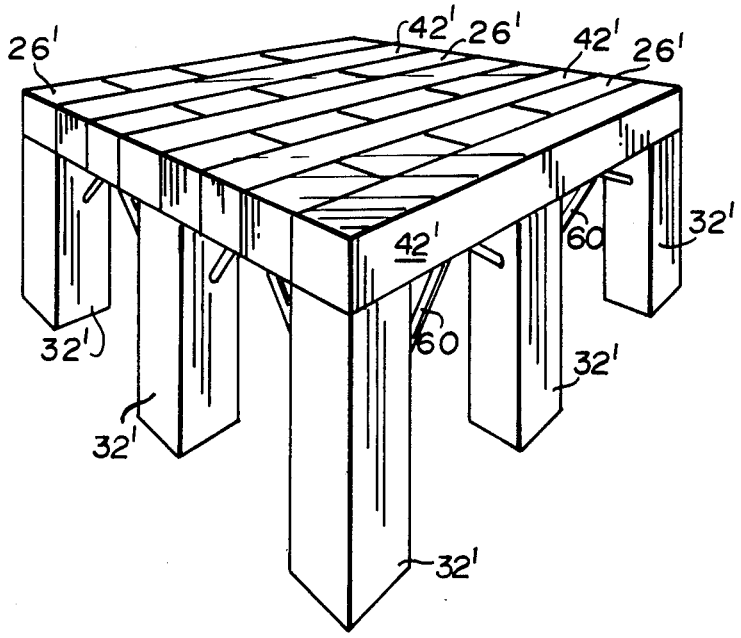

In FIGS. 28 and 29 there is disclosed a raised platform-like configuration which includes a plurality of elongated blocks 32', 26' and 42' which are interconnected by a plurality of tubular connectors 60. Connectors 60 are also utilized to provide an externally visible, truss-like configuration connecting various of the vertically arranged blocks with the horizontally arranged blocks.

Here again, the constructions illustrated in FIGS. 22 through 29 are merely exemplary of any number of constructions which are possible with the elastomeric foam blocks of this invention, used with or without the tubular connectors 60.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A single element toy construction block system comprising a plurality of individual, elastomeric reslient construction blocks of substantially identical composition, each block having a three dimensional configuration formed of an elastomeric foam composition, and including means for connecting said block to one or more other blocks of similar construction, said means comprising a plurality of integrally formed flexible protuberances and springy self-closing cellular receptacles present on all surfaces of all said blocks, said protuberances penetrating into said cellular receptacles clinging thereto when one or more surfaces of the blocks are forceably placed in contact with one another.

2. A single element toy construction block system as defined in claim 1 wherein said foam composition is selected from the group consisting essentially of esters, ethers, polyols, silicones and vinyls.

3. A single element toy construction block system as defined in claim 1 wherein said foam composition has a density value of about 0.5 to about 10.0 pounds per cubic foot.

4. A single element toy construction block system as defined in claim 1 wherein said foam has a cell size range from about 20 to about 80 cells per linear inch.

5. A single element toy construction block system as defined in claim 1 wherein said foam composition has an elongation in the range of about 200% to about 400%.

6. A single element toy construction block system as defined in claim 1 where in said foam has an Angle of Repose value of about 30 to about 50 degrees on plate glass or 404 grade stainless steel.

7. A single element toy construction block system as defined in claim 1 wherein each of said blocks is formed in a substantially rectangular shape.

8. A single element toy construction as defined claim 1 wherein each of said block is formed in a substantially triangular shape.

9. A single element toy construction block construction as defined claim 1 wherein each of said blocks is formed in a substantially cylindrical shape.

10. A kit toy comprising a plurality of blocks, each block of flexible uncoverd elastomeric foam composition having a three dimensional configuation and including pin means by which said block can be attached to another block of similar elastomeric foam construction, said pin means being insertable with said foam block in any direction, and without preformed perforations; said pin means held in place in resilient walled perforations created by the insertion of the pins into the foam by elastomeric forces inherent in the structure of the foam, said foam having a composition such that said perforations snap shut upon the removal of said pins.

11. A toy block as defined in claim 10 wherein said foam comprises polymers selected from the group consisting essentially of esters, ethers, polyols, silicones and vinyls.

12. A toy block as defined in claim 10 wherein said foam composition has a density value of about 0.50 to about 10.0 pounds per cubic foot.

13. A toy block as defined in claim 10, wherein said foam composition has a cell size value of about 20 to about 80 cells per linear inch.

14. A toy block as defined in claim 10, wherein said foam composition has an elongation value of about in the range of 200% to 400%.

15. A toy block as defined in claim 10 wherein said foam composition has an Angle of Repose of about 30 to about 50 degrees on plate glass or 404 grade stainless steel.

16. A toy block as defined in claim 10 wherein said block is formed in a substantially rectangular shape.

17. A toy block as defined in claim 10 wherein said block is formed in a substantially triangular shape.

18. A toy block as defined in claim 10 wherein said block is formed in a substantially cylindrical shape.

19. A toy block as defined in claim 10 wherein said pins are tubular connectors which range from 3.0 inches to 15.0 inches long and have a cross-sectional diameter ranging from 1/16th of an inch to 5/16ths of an inch, and a wall thickness range from 1/64th of an inch to 1/16th of an inch, and wherein said pins are made of plastic.

* * * * *